US010215404B2

(12) United States Patent
Lee et al.

(10) Patent No.: US 10,215,404 B2
(45) Date of Patent: Feb. 26, 2019

(54) DUAL VENTURI FOR COMBUSTOR

(71) Applicant: KYUNGDONG NAVIEN CO., LTD., Pyeongtaek-si, Gyeonggi-do (KR)

(72) Inventors: Hyeon Sik Lee, Bucheon-si (KR); Jun Kyu Park, Incheon (KR)

(73) Assignee: KYUNGDONG NAVIEN CO., LTD., Pyeongtaek-si, Gyeonggi-Do (KR)

( * ) Notice: Subject to any disclaimer, the term of this patent is extended or adjusted under 35 U.S.C. 154(b) by 542 days.

(21) Appl. No.: 14/648,904

(22) PCT Filed: Sep. 13, 2013

(86) PCT No.: PCT/KR2013/008309

§ 371 (c)(1),
(2) Date: Jun. 1, 2015

(87) PCT Pub. No.: WO2014/088192

PCT Pub. Date: Jun. 12, 2014

(65) Prior Publication Data

US 2015/0345784 A1 Dec. 3, 2015

(30) Foreign Application Priority Data

Dec. 3, 2012 (KR) ..... 10-2012-0139238

(51) Int. Cl.
*F23C 7/06* (2006.01)
*F23D 14/60* (2006.01)
(Continued)

(52) U.S. Cl.
CPC ..... *F23D 14/60* (2013.01); *F23D 14/64* (2013.01); *F23L 13/02* (2013.01); *F23N 1/02* (2013.01);
(Continued)

(58) Field of Classification Search
CPC ..... F23D 14/60; F23D 14/64; F23L 13/02; F23N 1/02; F23N 1/022
(Continued)

(56) References Cited

U.S. PATENT DOCUMENTS 1,067,449 A * 7/1913 Steward ..... F02M 9/103 261/44.9
2,004,003 A * 6/1935 Kennedy ..... F02M 7/22 261/44.2
(Continued)

FOREIGN PATENT DOCUMENTS

JP 10-089628 A 4/1998
JP 2002-267118 A 9/2002
(Continued)

OTHER PUBLICATIONS

Japanese Office Action, Japanese Application No. 2015-545348, Mar. 15, 2016, 4 pages (with concise explanation of relevance).
(Continued)

*Primary Examiner* — Avinash Savani
(74) *Attorney, Agent, or Firm* — Fenwick & West LLP

(57) ABSTRACT

The present invention relates to a dual venturi for a combustor and, specifically, to a dual venturi for a combustor, which adjusts the amount of gas and air supplied to a burner of a hot water heater and has a motor combined with a damper in order to increase a turn-down ratio (TDR), such that the damper is rotated by the driving of the motor so as to simultaneously open or close secondary air and gas inlets, thereby enabling efficient heating control. The present invention has a separate opening/closing means which is capable of controlling, in two stages, the amount of air and gas flowing into the combustor such as the hot water heater, wherein the opening/closing means comprises the motor and the damper, and the damper is rotated by the driving of the motor so as to simultaneously open or close the secondary air and gas inlets, thereby enabling the control of the amount of air and gas.

5 Claims, 7 Drawing Sheets

(51) Int. Cl.
*F23L 13/02* (2006.01)
*F23N 1/02* (2006.01)
*F23D 14/64* (2006.01)

(52) U.S. Cl.
CPC ..... *F23N 1/022* (2013.01); *F23N 2035/06* (2013.01); *F23N 2035/10* (2013.01); *F23N 2035/16* (2013.01); *F23N 2035/18* (2013.01)

(58) Field of Classification Search
USPC ..... 431/89; 136/601.16; 261/44.9
See application file for complete search history.

(56) References Cited

U.S. PATENT DOCUMENTS 3,266,785 A * 8/1966 Kennedy, Sr. ..... F02M 1/00 261/41.4
4,408,581 A * 10/1983 Pfalzgraf ..... F02D 9/102 123/337
4,526,729 A * 7/1985 Braun ..... F02M 7/22 137/868
2011/0139045 A1 6/2011 Zatti et al.
2013/0224670 A1* 8/2013 Zatti ..... F23D 14/02 431/38

FOREIGN PATENT DOCUMENTS

KR 10-2011-0031003 A 3/2011
KR 10-2011-0082809 A 7/2011
KR 10-2012-0109966 A 10/2012

OTHER PUBLICATIONS

PCT International Search Report, PCT/KR2013/008309, dated Nov. 11, 2013, 4 Pages.

* cited by examiner

DUAL VENTURI FOR COMBUSTOR

TECHNICAL FIELD

The present invention relates to a dual venturi for a combustor and, specifically, to a dual venturi for a combustor, which adjusts the amount of gas and air supplied to a burner of a hot water heater and has a motor combined with a damper, such that the damper is rotated by the driving of the motor so as to simultaneously open or close secondary air and gas inlets, thereby enabling efficient heat capacity control.

BACKGROUND OF THE INVENTION

In general, a combustor used for hot water use and heating, such as a boiler or a hot water heater, are classified into an oil boiler, a gas boiler, an electric boiler and a hot water heater depending on the fuel it is supplied with, and are diversely developed to fit different installation purposes.

Among these combustors, in particular, the gas boiler and the hot water heater generally use a Bunsen Burner or a Premixed Burner to combust gas fuel, and among these the combustion method of the premixed burner is carried out by mixing gas and air at a mixing ratio for optimal combustion state and supplying this mixture (air+gas) to a burner port for combustion.

Also, function of a combustor is evaluated by a turn-down ratio (TDR). The TDR refers to 'a ratio of maximum gas consumption to minimum gas consumption' in a gas combustion device in which the gas volume is variably regulated. For instance, if the maximum gas consumption is 24,000 kcal/h and the minimum gas consumption is 8,000 kcal/h, the TDR is 3:1. The TDR is controlled according to the ability to maintain a stable flame under minimum gas consumption condition.

In the gas boiler and the hot water heater, convenience of using hot water and heating increases with larger TDR. That is, if the TDR is small (meaning the minimum gas consumption is high) and the burner is operated for a small hot water and heating load, frequent On/Off of the combustor occurs, thereby deviation during temperature control increases and durability of the apparatus decreases. Therefore, various methods have been developed to increase the TDR applied to a combustor in order to improve aforementioned problems.

Valves which controls gas supply to these types of burners having proportional control are largely divided into electrical modulating gas valve, which is controlled by current value, and pneumatic modulating gas valve, which is controlled by differential pressure generated during air supply.

The pneumatic modulating gas valve controls the amount of gas supplied to the burner through differential pressure generated when air needed for combustion is supplied to the burner by a fan. At this time, the air and gas needed for combustion are mixed in the gas-air mixer and supplied to the burner as a mixture (air+gas).

In a gas-air mixer of a gas burner using such pneumatic modulating gas valve, the primary factor controlling the TDR is a relationship between gas consumption (Q) and differential pressure (ΔP). The general relationship between differential pressure and flow rate of a fluid is as follows:

$$Q=k\sqrt{(\Delta P)}$$

That is, differential pressure needs to be quadrupled in order to double flow rate of a fluid.

Therefore, differential pressure ratio must be 9:1 in order to have a TDR of 3:1, and the differential pressure ratio needs to be 100:1 to have a TDR of 10:1. However, it is impossible to infinitely increase the gas feed pressure.

In order to solve the above problem of being unable to infinitely increase the gas feed pressure, the present invention describes, as illustrated in FIG. 1, a method for increasing the turn-down ratio of the gas burner by dividing the gas and air supply paths into two or more sections, respectively, and opening/closing each passage of gas injected into the burner.

PRIOR ART

Patent Literature (Patent Literature 1) Korean Patent Application No. 10-2011-84417

DISCLOSURE OF INVENTION

Technical Problem

The aforementioned patent literature is a previously filed application by the applicant of the present invention. Referring to FIG. 1, it is directed to a gas-air mixer with branched flow passages, in which a gas supply pipe (12) that is divided into two sections is connected to one side of an air supply pipe (13) and a separate branching mechanism (170) is provided inside the air supply pipe (13). As a result, valve bodies (161, 162) connected to a rod (163) opens and closes a gas flow path (116) and an air flow path (118) via the up and down motion of the rod (163) connected to an electromagnet (165), and through this the boiler can be controlled with low output mode and high output mode, to improve the TDR.

However, first, in the above gas-air mixer with branched flow paths, the air flow path (118), which is a cylindrically shaped path, is partitioned by the branching mechanism (170) to control air inflow in two stages. Thus, it is impossible to expand the air flow path (118) when larger air inflow is needed, and as a result high TDR cannot be realized.

Second, gas differential pressure cannot be formed since areas of each gas flow path (115, 116) are identical, and thus it is difficult to effectively increase the TDR.

Third, injection molding or die-casting process is used when producing the above gas-air mixer, resulting in a large margin of error for the dimensions and accuracy, and burr formation during production which needs to be removed through a further step.

Fourth, the gas-air mixer must be manufactured according to capacity since the required load heat capacity differs according to combustor capacity. As a result, product planning and design costs increased.

The present invention has been invented to solve the above-described problems, and an object of the present invention is to provide a dual venturi for a combustor having a separate opening/closing means for controlling, in two stages, an amount of air and gas flowing into a combustor such as a hot water heater, in which the opening/closing means comprises a motor and a damperand the damper is rotated by the operation of the motor so as to simultaneously open or close the secondary air and gas inlets, thereby controlling the amount of air and gas.

Technical Solution

A dual venturi for a combustor according to the present invention, which aims to solve the above-described problem comprises, a housing provided with an outlet connected to a fan on one side and a predetermined space in the inner side thereof through which gas and air can flow; an air supply unit divided by a first partition into a first air supply unit and a second air supply unit having an opening/closing hole in the middle; a gas supply unit formed on one side of the housing and divided by a second partition into a first gas supply unit that is connected to the first air supply unit and a second gas supply unit that is connected to the second air supply unit via the opening/closing hole; a gas inlet formed on a side surface of the gas supply unit and configured to allow simultaneous inflow of first gas and second gas, the first gas inlet being formed on the first gas supply unit and the second gas inlet being formed on the second gas supply unit; and an opening/closing means which blocks the flow of second air flowing into the second air supply unit and second gas flowing into the second gas supply unit when the combustor requires low heat capacity, and opens the second air supply unit and the second gas supply unit when high heat capacity is needed.

In one embodiment, the opening/closing means comprises an opening/closing unit provided in the middle of the second air supply unit which allows flow of or blocks, via a damper that is rotated by the operation of the motor, air flowing through the second air supply unit and gas flowing through the second gas supply unit.

In one embodiment, the opening/closing unit comprises a damper connected to a motor shaft of the motor through a shaft hole provided in its center, with two or more protrusions at the edge of the shaft hole and recesses which are relatively recessed with respect to the protrusions alternatively formed thereon; a moving body provided with protrusions and recesses each corresponding to the above protrusions and recesses such that the ends of each protrusion come into contact with each other by the rotation of the damper and thereby carry out forward/reverse motion; a valve connected to one end of the moving body and which allows flow of or blocks the air or gas flowing through the second air supply unit and the second gas supply unit by opening and closing the opening/closing hole according to the forward/reverse motion of the moving body; and a first spring provided between the damper and the moving body to provide elastic force for support and a return force for when the valve closes the opening/closing hole after opening it.

In one embodiment, the dual venture for a combustor further comprises a second spring interposed between the first partition and the moving body to rapidly return the moving body when the opening/closing hole is closed by the moving body returning to the damper side via the rotation of the damper.

In one embodiment, the valve further comprises a sealing member for maintaining airtightness between the opening/closing hole and the valve.

In one embodiment, the first air supply unit and the second air supply unit each further comprise a removable internal housing for load adjustment on the inner side, which can control the amount of air according to the heat capacity load required for combustion.

Advantageous Effects

Using the dual venturi for a combustor according to the present invention, first, fuel cost can be reduced by controlling high heat capacity or low heat capacity required for the combustor.

Second, since the first air supply unit and the second air supply unit have a separate internal housing coupled to the inner side according to the required load, flexible response to the heating load needed by each combustor is possible just by replacing the respective internal housing according to different load, thereby product planning, design and cost are decreased which increases economic feasibility.

Third, components of the dual venturi are simplified, thereby shortening the design time relating to product manufacturing, reducing the production period, and simplifying repair when product is broken.

Fourth, the dual venturi structure is simplified since it is not necessary to configure the first gas and second gas inlets as separate structures.

DESCRIPTION OF THE PREFERRED EMBODIMENTS

Figure 1:
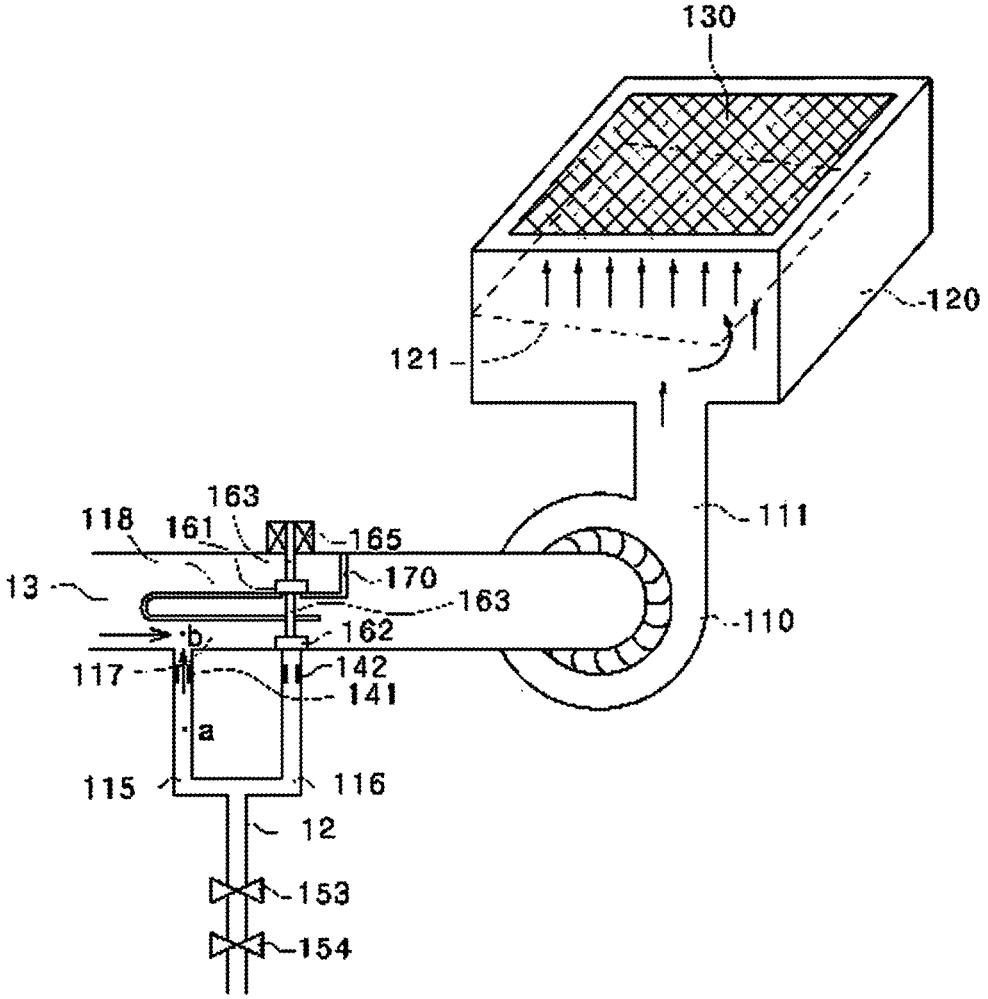
FIG. 1 PRIOR ART
FIG. 1 is a drawing showing the prior art.

Hereinafter, preferred embodiment of the present invention will be described with reference to the accompanying drawings. The embodiment of the present invention can be modified into various forms, and it should be understood that the scope of present invention is not limited to the embodiments whose detailed description is provided below. The following embodiments are given to provide a more detailed description of the preset invention to those skilled in the art. Therefore, shapes of the elements, etc. may be exaggerated in the drawings for a clearer understanding of the description. Identical or corresponding elements in each drawing may be designated with same reference signs. In addition, description of known functions or configurations determined to hinder understanding of the present invention are omitted.

Hereafter, an exemplary embodiment of the dual venturi for a combustor of the present invention will be described in detail with reference to the accompanying drawings.

Figure 2:
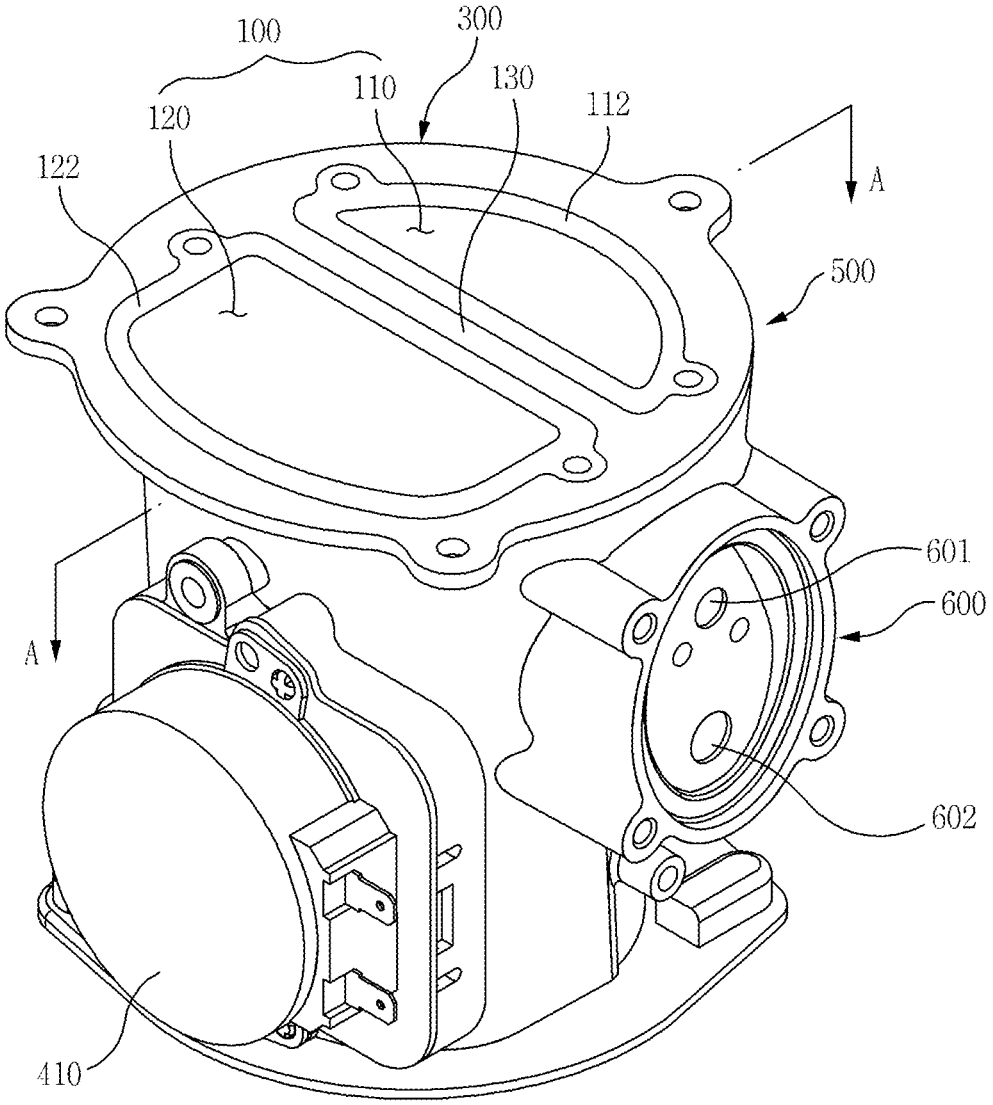
FIG. 2 is a perspective view showing the dual venturi for a combustor according to the present invention.
Figure 3:
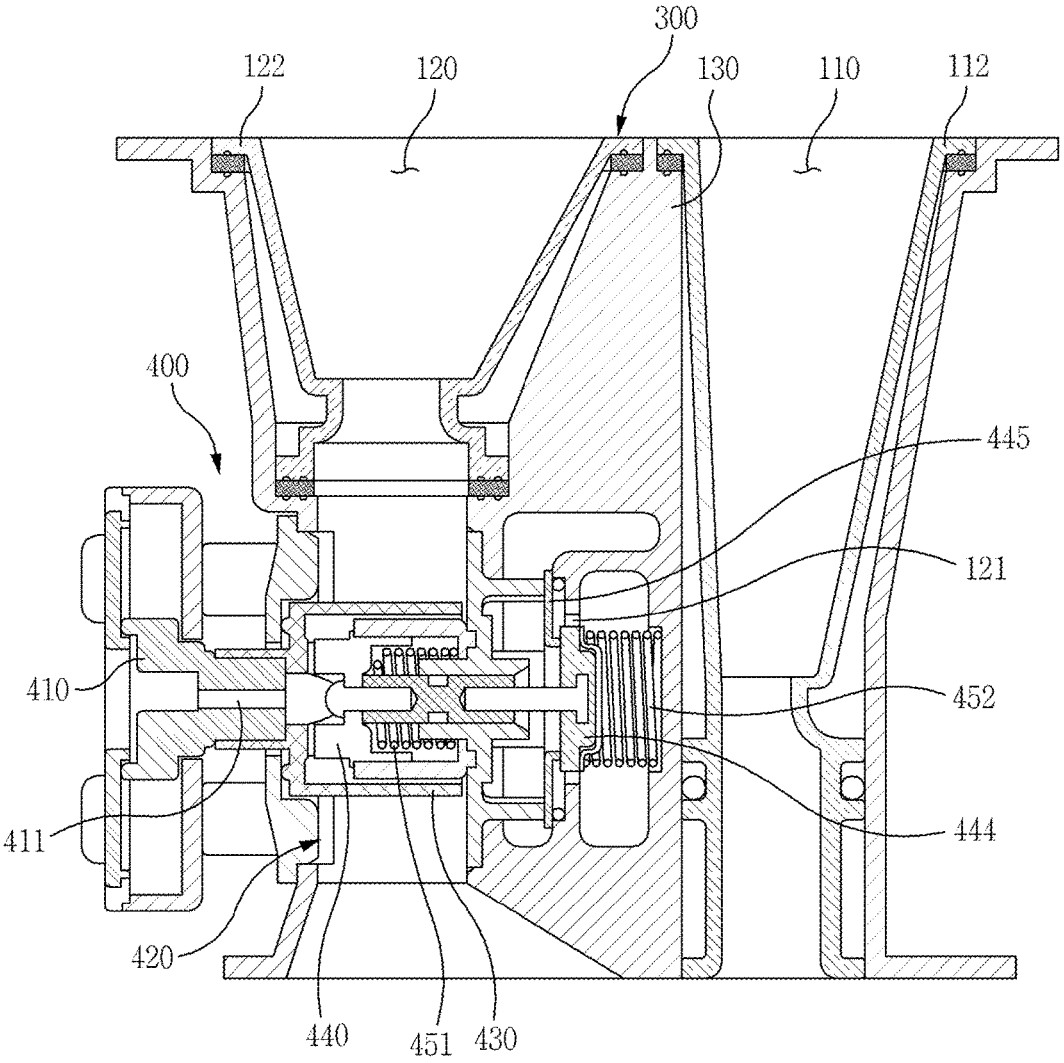
FIG. 3 is a cross-sectional view taken along line A-A of FIG. 2.
Figure 4:
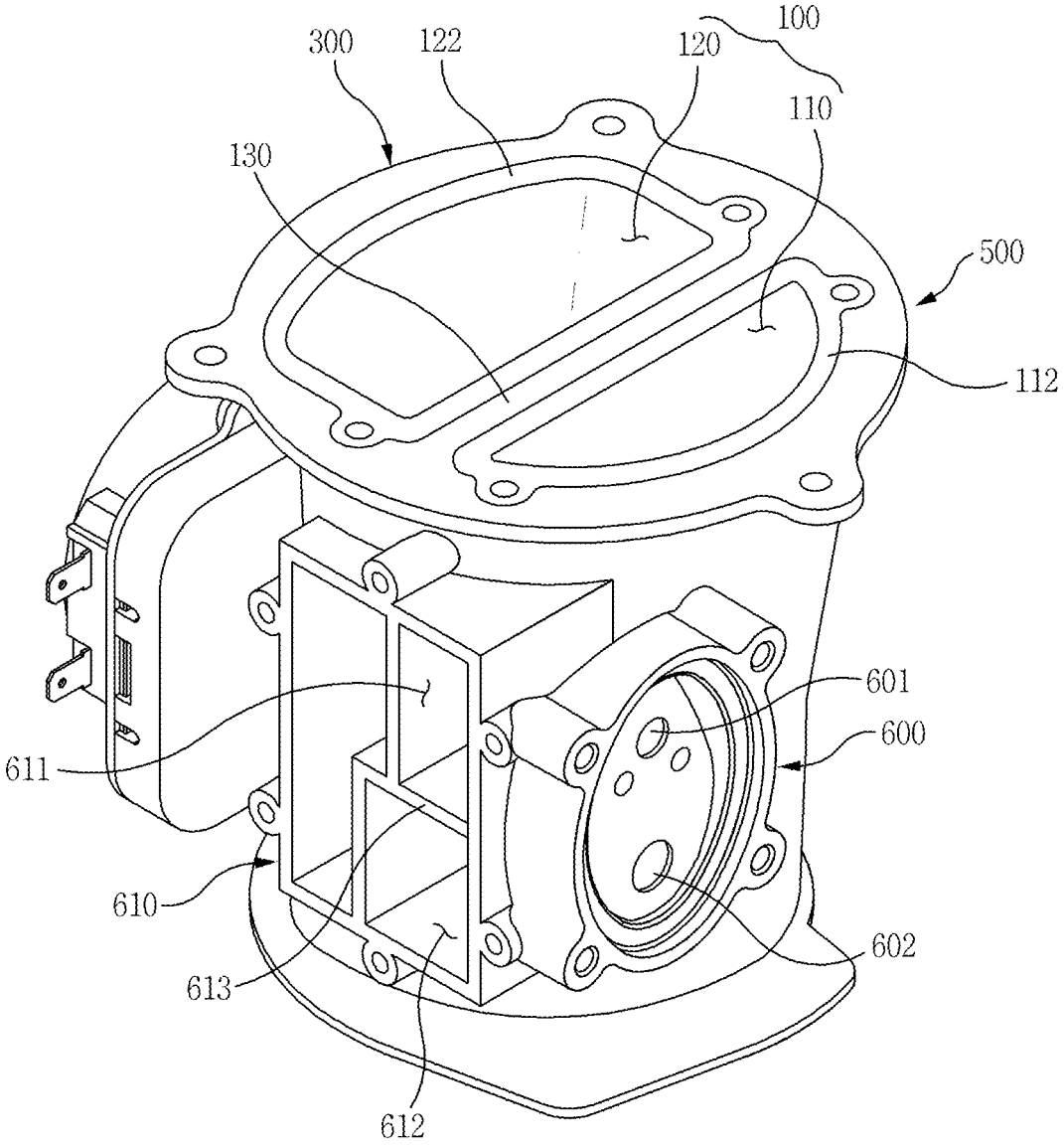
FIG. 4 is a perspective view showing the interior of the gas supply unit provided in FIG. 2.
Figure 5A:
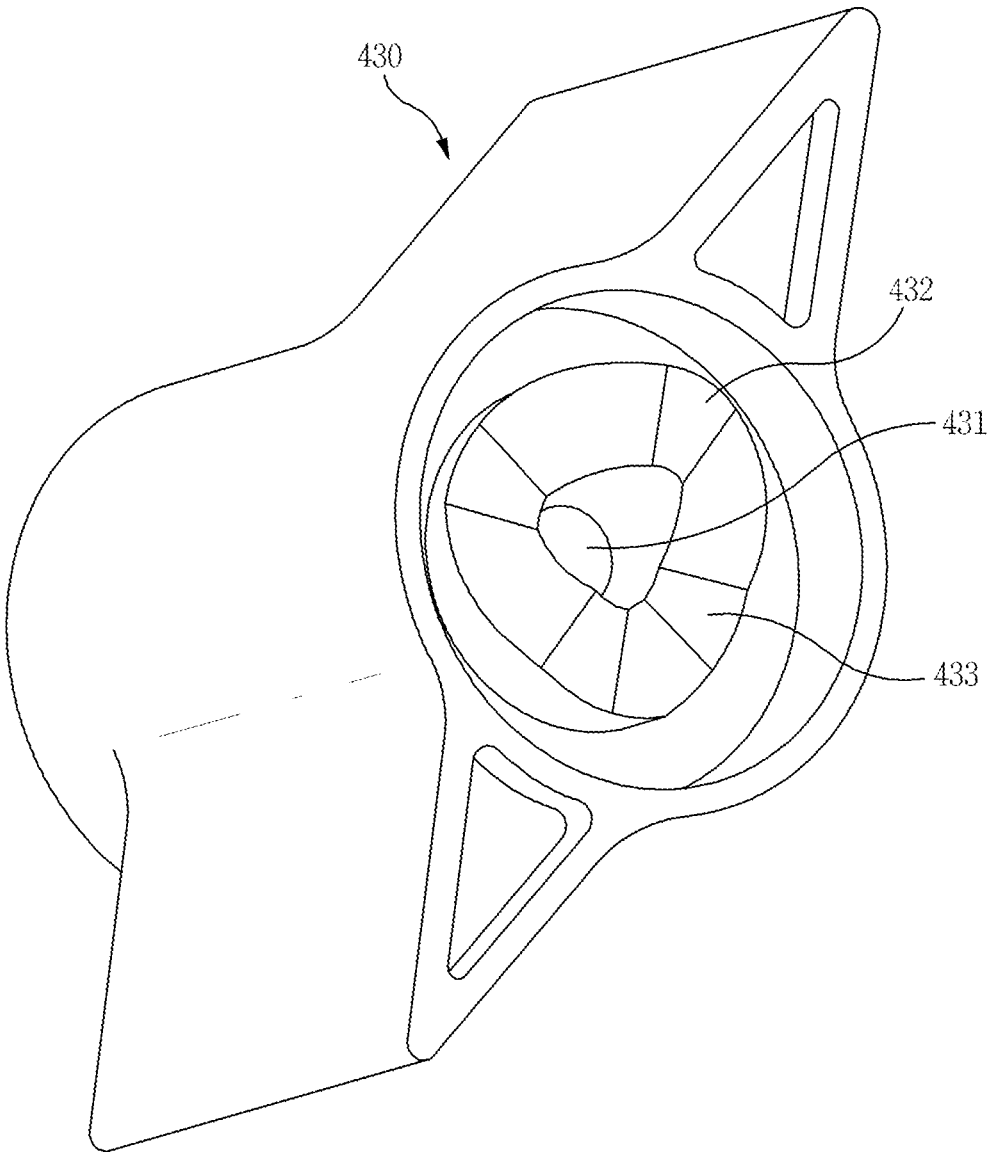
FIG. 5*a* is a perspective view showing the interior of the damper provided in FIG. 3
Figure 5B:
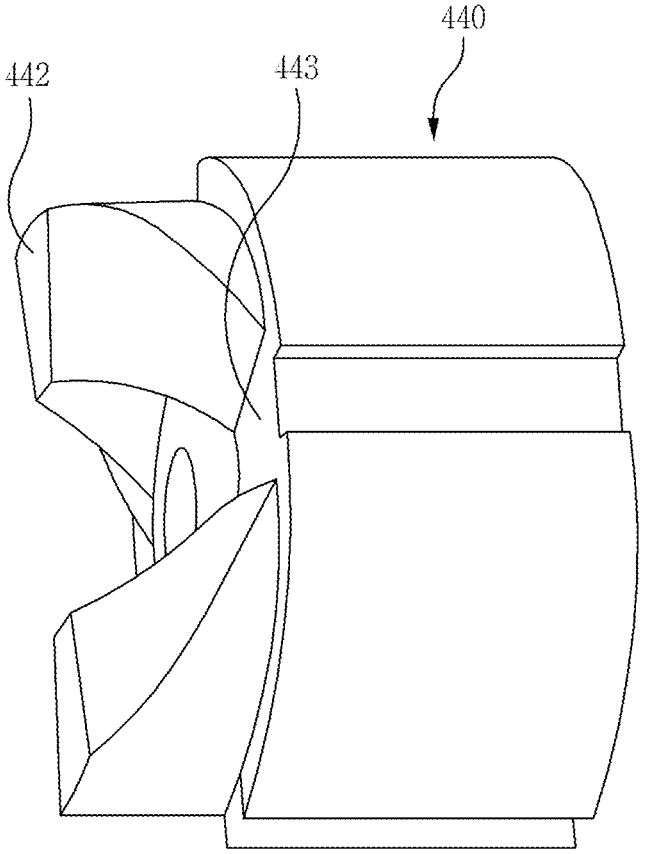
FIG. 5*b* is a perspective view showing the moving body.
Figure 6:
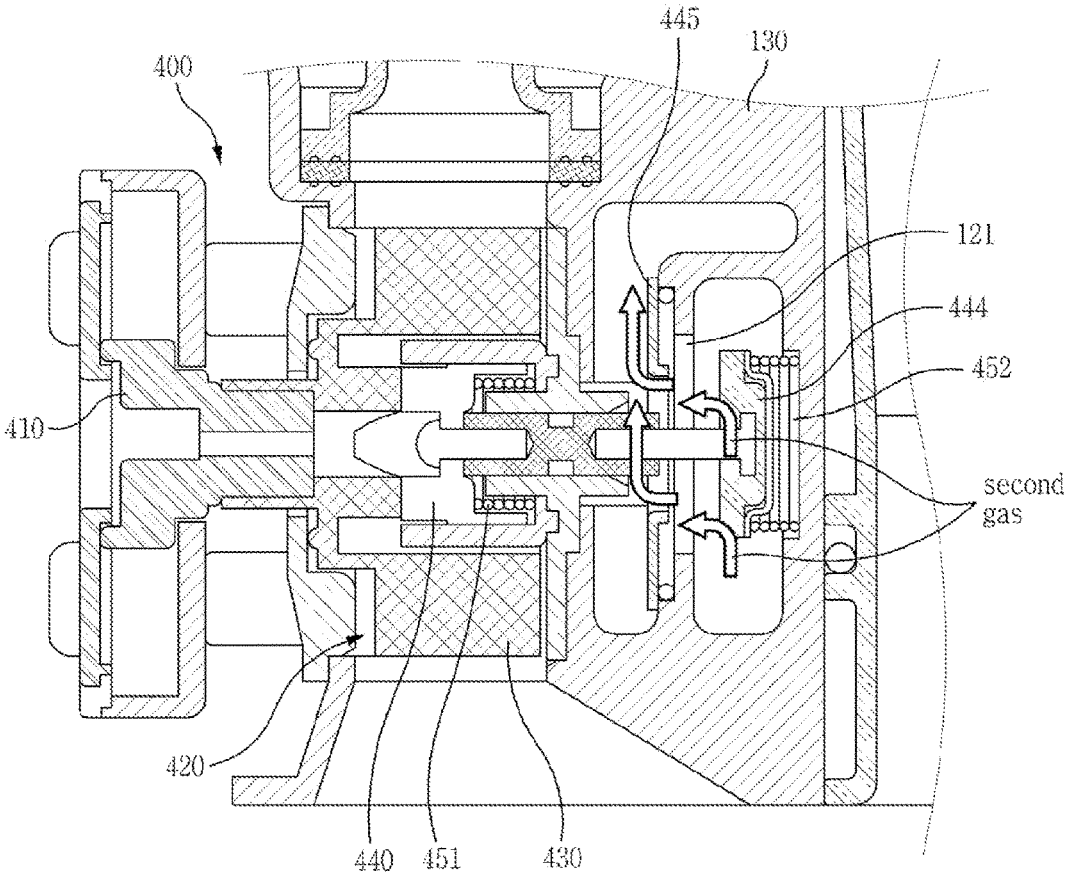
FIG. 6 is a drawing explaining the operating state of the dual venturi for a combustor according to the present invention.

In the accompanying drawings, FIG. 2 is a perspective view showing the dual venturi for a combustor according to the present invention, FIG. 3 is a cross-sectional view taken along line A-A of FIG. 2, FIG. 4 is a perspective view showing the interior of the gas supply unit provided in FIG. 2, FIG. 5*a* is a perspective view showing the interior of the damper provided in FIG. 3, FIG. 5*b* is a perspective view showing the moving body, and FIG. 6 is a drawing explaining the operating state of the dual venturi for a combustor according to the present invention.

Referring to FIG. 2 to FIG. 6, the dual venturi for a combustor of the present invention is provided with a housing (500) having a predetermined space in the inner side thereof through which air and gas can flow and an outlet (300) connected to a fan (not shown) on one side.

An air supply unit (100) is formed on the inner side of the housing (500) and divided by a first partition (130) into a first air supply unit (110) and a second air supply unit (120).

Meanwhile, as shown in FIG. 3 and FIG. 4, a gas supply unit (610) is formed on one side of the housing (500) and divided by a second partition (613), in which a first gas supply unit (611) is connected to the first air supply unit (110), and a second gas supply unit (612) is connected to the second air supply unit (120) by an opening/closing hole (121). Therefore, there is no need to separately establish the conventional first and second gas flow paths since the gas supply unit (610) is integrally formed and the first and second gases are completely separated by the second partition (613).

Further, a gas inlet (600) is formed on the side of the gas supply unit (610) such that the first gas and the second gas can flow in simultaneously, in which the first gas inlet (601) is formed on the first gas supply unit (611) side and the second gas inlet (602) is formed on the second gas supply unit (612).

On the other hand, an opening/closing means (400) is coupled to the middle of the second air supply unit (120). The opening/closing means (400) can control the heat capacity according to the heat capacity load required by the combustor by blocking the flow of air and gas flowing through the second air supply unit (120) and the second gas supply unit (612) while opening the second air supply unit (120) and the second gas supply unit (612) when high heat capacity is needed.

Further describing the opening/closing means (400) with reference to FIG. 3 to FIG. 6, the opening/closing means (400) is provided with an opening/closing unit (420) in the middle of the second air supply unit (120) to block or allow flow of air and gas flowing through the second air supply unit (120) and the second gas supply unit (612) by a damper (430) that is rotated by the operation of a motor (410).

The opening/closing unit (420) is provided with a damper (430) connected to a motor shaft (411) of the motor (410) through a shaft hole (431) provided in its center, with two or more protrusions (432) at the edge of the shaft hole (431) and recesses (433) which are relatively recessed with respect to the protrusions (432) alternatively formed thereon.

Further, the opening/closing unit (420) is equipped with a moving body (440) having protrusions (442) and recesses (443) corresponding to the protrusions (432) and recesses (433) of the damper (430) such that the ends of each protrusion (432, 442) comes into contact with each other by the rotation of the damper (430), to move forward and in reverse.

Meanwhile, a valve (444) is connected to one end of the moving body (440) to allow flow of or block the air or gas flowing through the second air supply unit (120) and the second gas supply unit (612) by opening and closing the opening/closing hole (121) according to the forward/reverse motion of the moving body (440).

In addition, a first spring (451) is provided between the damper (430) and the moving body (440) to provide elastic force for support and a return force for when the valve (444) closes the opening/closing hole (121) after opening it.

On the other hand, a second spring (452) is interposed between the first partition (130) and the moving body (440) to rapidly return the moving body (440) when the opening/closing hole (121) is closed by the moving body (440) returning to the damper (430) side via the rotation of the damper (430).

Also, the valve (444) can further comprise a sealing member (445) to maintain airtightness between the opening/closing hole (121) and the valve (444). Therefore, the second gas supply can be completely blocked during low heat capacity operation of the combustor.

The first air supply unit (110) and the second air supply unit (120) can each further comprise a removable internal housing (112, 122) for load adjustment on the inner side, which can control the amount of air according to the heat capacity load required for combustion. Thus, the internal housing (112, 122) which is formed in various volumes according to the heat capacity load is configured to be removable.

Accordingly, when producing a combustor with small capacity, the combustor can be used by just replacing the internal housing (112, 122) of a small volume, that is needed for the combustor, on the inner side of the first air supply unit (110) and the second air supply unit (120) without designing a separate dual venturi, thereby increasing economic feasibility.

Hereafter, operating state of the dual venturi for a combustor of the present invention configured as above will be described in detail.

As illustrated in FIG. 3, in regards to supplying only the first gas and the first air in the hot water heater, the second air supply unit (120) is closed by the damper (430) of the opening/closing unit (420) rotating horizontally to the flow direction of the air and gas of the second air supply unit (120), and at the same time the recess (443) of the moving body (440) and the protrusion (432) of the damper (430), as well as the protrusion (442) of the moving body (440) and the recess (433) of the damper (430) are kept in contact with each other. At this time, inflow of the second gas is blocked since the valve (444) of the moving body (440) is blocking the opening/closing hole (121), and the inflow of the second air is blocked since the damper (430) is rotated to be horizontal to the second air supply unit (120). Here, the first and second gases flow simultaneously into the gas inlet (600), but the valve (444) blocks the opening/closing hole (121) formed on the second air supply unit (120), thus the inflow of second gas is also blocked.

Therefore, since the mixture of air and gas mixed together flows into the fan only through the first gas supply unit (611) and the first air supply unit (110), the combustor can be operated with low heat capacity.

On the other hand, in order to drive the combustor with high heat capacity, power must be applied to the motor (410) to rotate the damper (430) by 90 degrees so that the damper (430) rotates to be in the same direction as the lengthwise direction of the second air supply unit (120), as shown in FIG. 6.

The protrusions (432) and recesses (433) formed inside the damper (430) rotate at the same time as the damper (430) rotation, resulting in respective protrusions (432, 442) (ends) of the damper (430) and moving body (440) to be in contact with each other, thereby the moving body (440) is pushed by the rotation of the damper (430) to move forward.

Here, the second gas flowing through the second gas supply unit (612) flows into the opening/closing hole (121) when the valve (444) coupled to the rear part of the moving body (440) moves away from the sealing member (445), and the second gas is mixed with the second air flowing in through the second air supply unit (120). This is then mixed with the air and gas flowing through the first air supply unit (110) and the first gas supply unit (611) to produce even more mixture, which then flows to the fan to operate the combustor with high heat capacity. Here, the first spring (451) is interposed between the damper (430) and the moving body (440), thus respective protrusions (432, 442) can maintain contact with each other by the elastic force of the first spring In order to operate the combustor with low heat capacity later on, the motor (410) is operated to rotate the damper (430) by 90 degrees again, which results in the state as shown in FIG. 3, and the second air supply unit (120) and opening/closing hole (121) are closed to operate the combustor with low heat capacity. Here, the second spring (452) is interposed between the first partition (130) and the moving body (440). Thus, return force is increased so that each protrusion (432, 442) and recess (433, 443) of the moving body (440) and the damper (430) can respectively be engaged when the damper (430) rotates to close the second air supply unit (120).

The above description relating to a preferred embodiment of a dual venturi for a combustor according to the present invention is merely an example. It will be understood by the skilled person in the art that various modifications and other similar embodiments based on the description provided can be made. Therefore, it is clear that the present invention is not limited to the preferred embodiment described above. Accordingly, the scope of the invention to be protected must be based on the technical principles of the accompanying claims. Further, it must be understood that various modifications, additions and substitutions are possible, without departing from the scope and spirit of the invention as disclosed in the accompanying claims.

REFERENCE SIGNS

100: Air Supply Unit 110: First Air Supply Unit
112: Internal Housing 120: Second Air Supply Unit
121: Opening/Closing Hole 122: Internal Housing
130: First Partition 300: Outlet
400: Opening/Closing Means 410: Motor
411: Motor Shaft 420: Opening/Closing Unit
430: Damper 430: Shaft Hole
432: Protrusion 433: Recess
440: Moving Body 442: Protrusion
443: Recess 444: Valve
451: First Spring 452: Second Spring
500: Housing 600: Gas Inlet
601: First Gas Inlet 602: Second Gas Inlet
610: Gas Supply Unit 611: First Gas Supply Unit
612: Second Gas Supply Unit 613: Second Partition

The invention claimed is:

1. A dual venturi for a combustor, comprising:

a housing;

an air supply unit within the housing, the air supply unit comprising a first air supply unit and a second air supply unit separated from the first air supply unit by a first partition, the first partition formed with an opening/closing hole;

a gas supply unit formed on one side of the housing, the gas supply unit comprising a first gas supply unit and a second gas supply unit separated from the first air supply unit by a second partition, the first gas supply unit connected to the first air supply unit, the second gas supply unit connected to the second air supply unit through the opening/closing hole;

a damper rotatably disposed in the second air supply unit and configured to allow or block air flowing through the second air supply unit, the damper having a hollow cylindrical portion disposed within the second air supply unit, two or more first protrusions and first recesses which are relatively recessed with respect to the first protrusions alternatively disposed in the hollow cylindrical portion;

a moving body disposed in the hollow cylindrical portion, the moving body having second protrusions and second recesses that are respectively corresponding to the first protrusions and the first recesses and configured to, according to rotation of the damper, move in a first direction by contact of ends of the second protrusions with ends of the first protrusions and move in a second direction by ends of the second protrusions being disposed in the first recesses within the hollow cylindrical portion;

a valve connected to the moving body, the valve configured to allow flow of gas through the second gas supply unit into the second air supply unit by opening the opening/closing hole while simultaneously moving as the moving body moves in the first direction or block flow of gas flowing through the second gas supply unit into the second air supply unit by closing the opening/closing hole while simultaneously moving as the moving body moves in the second direction; and a first spring disposed within the hollow cylindrical portion and connected to the moving body, and configured to provide a return force to the moving body in the second direction.

2. The dual venturi of claim 1, further comprising:

a second spring disposed in the first partition and connected to the valve and configured to provide a return force to the valve in the second direction.

3. The dual venturi of claim 1, wherein the valve further comprises a sealing member to maintain airtightness between the opening/closing hole and the valve.

4. The dual venturi of claim 1, wherein when the opening/closing hole is open by a motion of the moving body in the first direction, the opening/closing hole is positioned between the moving body and the valve.

5. The dual venturi of claim 1, wherein the first air supply unit and the second air supply unit each further comprise a removable internal housing for load adjustment on an inner side of the first air supply unit and an inner side of the second air supply unit, which can control an amount of air according to a heat capacity load required for combustion and is able to adjust a turn down ratio by the heat capacity load required form the combustion.

* * * * *